US005109642A

United States Patent [19]

Ayala et al.

[11] Patent Number: 5,109,642

[45] Date of Patent: May 5, 1992

[54] MULTI-STORY CAR PARK

[75] Inventors: Francisco Ayala, El Prat De Llobregat; Jose M. Estradera, Barcelona, both of Spain

[73] Assignee: Camunsa Manutencion S.A., Barcelona, Spain

[21] Appl. No.: 571,256

[22] Filed: Aug. 21, 1990

[30] Foreign Application Priority Data

Aug. 21, 1989 [ES] Spain ..... 8902903

[51] Int. Cl.[5] ..... E04H 11/04

[52] U.S. Cl. ..... 52/79.1; 52/174; 52/175; 414/233; 414/241; 414/245; 414/246

[58] Field of Search ..... 52/79.1, 79.2, 175, 52/174; 414/233, 242-247, 250, 237, 264

[56] References Cited

U.S. PATENT DOCUMENTS 1,816,053 7/1931 McGavin ..... 414/240
1,919,269 7/1933 Becker ..... 414/256
4,874,280 10/1989 Gamberini ..... 414/242

FOREIGN PATENT DOCUMENTS 0275004 7/1988 European Pat. Off. ..... 52/175
2928288 7/1979 Fed. Rep. of Germany ..... 52/175
792864 2/1954 United Kingdom .

*Primary Examiner*—David A. Scherbel
*Assistant Examiner*—Kien T. Neuyen
*Attorney, Agent, or Firm*—Cushman, Darby & Cushman

[57] ABSTRACT

Multi-story car park, comprising parking floors divided into lanes having a width approximately equal to the length of the vehicle, and a length which is a multiple of the width of the vehicle, these lanes being sub-divided into elevator lanes (2), in which there are elevators to move the vehicle vertically, fixed space lanes (4) for the parking of vehicles, and flexible space lanes (3) situated between the elevator lanes (2) and the fixed space lanes (4).

8 Claims, 2 Drawing Sheets

MULTI-STORY CAR PARK

BACKGROUND OF THE INVENTION

This invention relates to a multi-story car park which has at least one floor for receiving and delivering vehicles, with direct access to the public road, and at least one floor on which vehicles are parked.

Car parks of this type exist wherein the reception/-delivery floor(s) are linked to the parking spaces by ramps, by means of which the drivers go up or down with their vehicles in motion. On the parking floors, the marked spaces are usually in alignment, thereby taking maximum advantage of the available surface area. However, between the various rows of parking spaces there must be lanes of sufficient width to allow for the vehicles to arrive and leave the spaces, maneuvering and turning as necessary. This system greatly reduces the parking capacity of the various floors since a large part of the surface area must be left free for the circulation and maneuvering of vehicles.

In addition, the upwards/downwards ramps reduce the useable surface area of the parking floors In an attempt to solve this problem, elevators have been installed by means of which the vehicles are moved from the reception/delivery floor(s) to the parking floors, and vice versa. However, transfer from the elevator to the parking space on each floor is by traditional methods, i.e. by driving the vehicle, making it necessary for each floor to have lanes and spaces for circulation and maneuvering, thereby reducing the parking area.

In both cases, because the vehicles must be moved by their drivers, it is necessary, furthermore, for the various floors to have a height sufficient to allow people to move about, this height being far greater than necessary for the actual parking of the vehicles. In this way, only a part of the height of the structure is occupied by vehicles.

In short, with traditional construction and distribution methods, only a small part of the overall volume is occupied by vehicles.

SUMMARY OF THE INVENTION

The aim of this invention is to develop a multi-story car park, of the type mentioned above, using a new concept of space distribution and method of moving the vehicles within the car park so that a much greater number of vehicles can be parked, relative to the actual size of the building.

Another aim of this invention is to develop a car park whereby after entering through the public road access, all movement of vehicles within the car park is automatic, with respect to both the delivery and reception of the vehicles.

In accordance with this invention, the first phase in building a car park is to study the site available and to make, within its outline, a closed polygonal shape which is equal in size to multiples of the length and width of the type of vehicle to be parked therein, in this way taking maximum advantage of the surface area available.

The car park has a reception/delivery floor, or one for each operation, which has a height sufficient to allow people to move about, and a series of vehicle parking floors which have a height just sufficient to accommodate the type of vehicle in question, since the drivers will not have to move about on these floors and the vehicles will not circulate with their engines turned on.

The size of the columns of the structure can be adjusted to multiples of the width and length of the vehicle in question, without having to take into account the turning circle of these vehicles, since they are moved within the parking floors in two perpendicular directions.

In accordance with this invention, the parking floors are divided into consecutive parallel lanes, all having a width approximately equal to the length of the vehicle in question and a length which is a multiple of the width of the vehicle.

These lanes are sub-divided into elevator lanes, fixed space lanes and flexible space lanes.

The elevator lanes within the parking floors are where elevators are situated, these moving the vehicles vertically from and to the reception/delivery floor(s).

The fixed space lanes are those in which the vehicles are parked and are situated on either side of the elevator lanes.

Lastly, the flexible space lanes are located between the elevator lanes and the fixed space lanes are used to move the vehicles horizontally, both parallel and perpendicular to the other two lanes, from the fixed space lanes to the elevators, and vice versa.

Each fixed space has a mechanism to allow for the longitudinal movement of vehicles in both directions, perpendicular to the length of the fixed space lane. These mechanisms can consist of fixed tables or platforms which have automatic haulage facilities to move the vehicles perpendicular to the lanes.

The flexible spaces have mechanisms which allow for the longitudinal and transverse movement of the vehicle in a perpendicular and parallel direction to the lanes. These mechanisms can comprise tables or platforms which can move in a lateral direction, parallel to the lanes, these table shaving automatic haulage facilities to move the vehicles perpendicular to the lanes.

Lastly, the lifts or elevators include mechanisms to move the vehicles through the access doors, perpendicular to the lanes. The lifts can have tables or platforms of which the height can be varied, with automatic haulage facilities to move the vehicles in and out of the lifts, perpendicular to the lanes.

The elevator lanes can also have fixed spaces located between the elevators, and parallel to the same.

The reception/delivery floor(s) include platforms of sufficient size to accommodate a vehicle, these revolving platforms being situated adjacent to the entrance/exit of the elevators and having automatic haulage facilities to move the vehicles longitudinally in both directions.

By means of this form of construction, as many vehicles can be parked on each floor as exist fixed spaces, these being located in the fixed space lanes located between the elevators. In addition, the flexible space lanes can be filled in part by vehicles, these being distributed in such a way that vehicles can be parked and withdrawn by means of lateral movements from and to the fixed spaces. The elevators and vehicle movement mechanisms can be activated automatically in such a way that to deliver a vehicle. The driver deposits the car at a pre-defined point of the reception floor, turn off the engine and get out of the car to insert a computer card containing the details of the vehicle into a suitable machine. The vehicle is then moved into the elevator automatically, without any action being necessary on the part of the driver, and by means of an appropriate computer system, the vehicle is transferred to the floor and spaced assigned.

In order to withdraw the vehicle, the driver uses the same card as for the delivery operation and the vehicle, with its engine turned off, is returned to a set position on the delivery floor by an automatic operation, without any action being necessary on the part of the driver.

Within the various parking floors, in the flexible space lanes there are empty spaces which do not have sliding tables. These spaces are assigned in such a way that when the tables are moved along the lanes, each one can reach at least one elevator.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

DETAILED DESCRIPTION OF THE PRESENTLY PREFERRED EXEMPLARY EMBODIMENT

Figure 1:
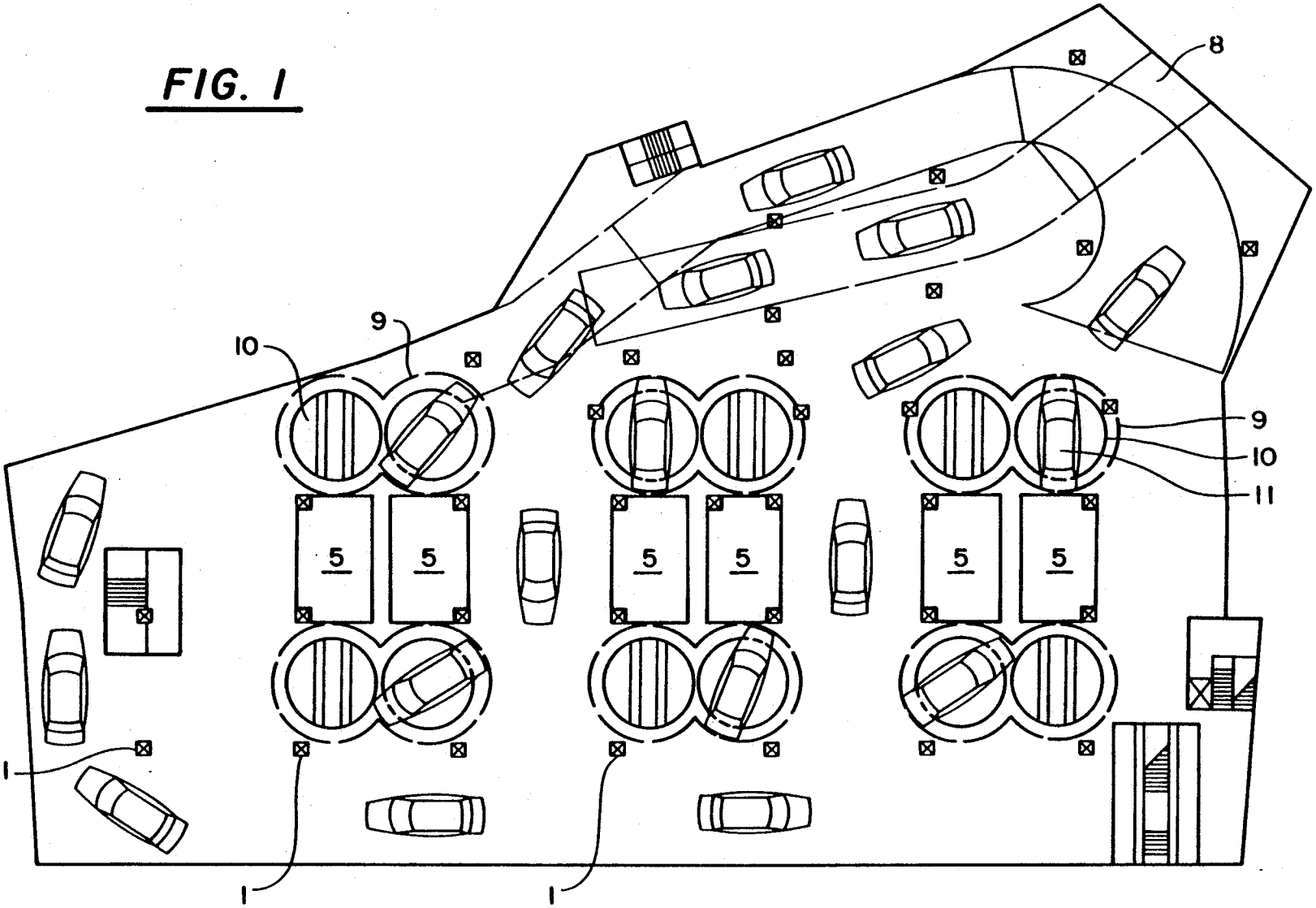
FIG. 1 shows a reception/delivery floor of a car park built in accordance with this invention.
Figure 2:
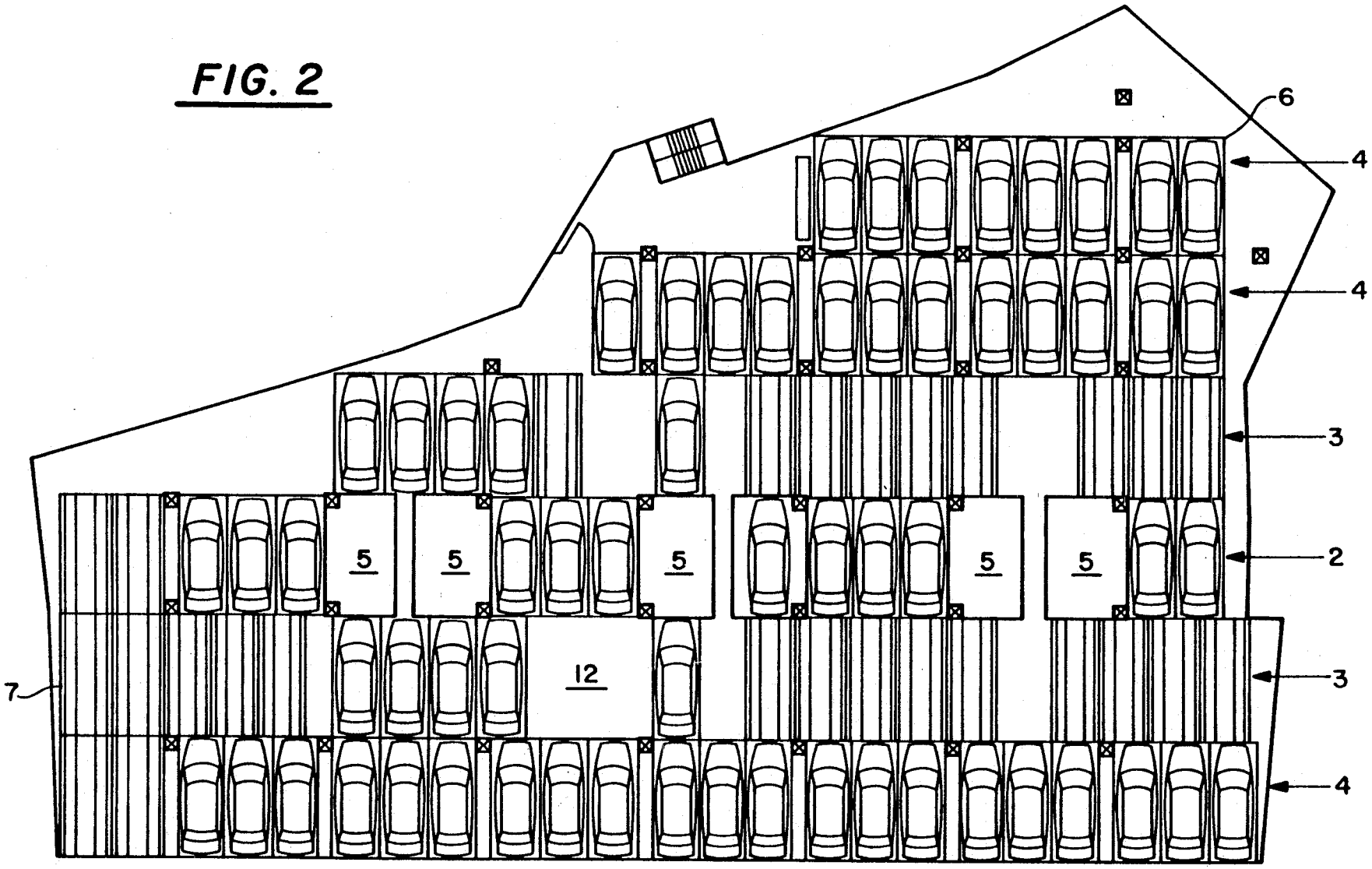
FIG. 2 shows a parking floor of a car park built in accordance with this invention.

FIG. 1 shows a reception/delivery floor, having a shape defined by a closed polygon within the outline of the available site. The shape of the parking floors, one of which is shown in FIG. 2, corresponds to that of the reception/delivery floor shown in FIG. 1.

The reception/delivery floor has a height sufficient to allow for people to move about whereas the height of the parking floors (FIG. 2) is just sufficient for a vehicle to be parked, since within these parking floors the drivers do not move about and the vehicles are not driven with their engines turned on.

The positioning of the columns within the structure of the building can be adjusted to multiples of the width and height of the vehicle in question, without it being necessary to take into account the turning or maneuvering circle of the vehicle in question, since all movement of these vehicles within the parking floors is along a cartesian axis.

In order to understand more fully this invention, the distribution and structure of the parking floors will now be explained with reference to FIG. 2.

The surface area of the floor, delimited by a closed polygonal shape, is divided into a series of consecutive lanes which have a width equal to the length of the vehicle to be parked in the car park and a length which is a multiple of the width of the vehicle. These lanes are sub-divided into elevator lanes 2 flexible space lanes 3 and fixed spaced lanes 4.

Within the elevator lanes 2 there are elevators 5 to move the vehicles vertically between the various floors. The flexible space lanes 3 are situated on either side of the elevator lanes(s) 2 and the fixed space lanes 4 are situated adjacent to the flexible space lanes 3.

The fixed space lanes 4 are used for parking the cars, as shown in FIG. 2. The flexible space lanes 3 are used to move the vehicles horizontally from the elevators 5 to the fixed space lanes 4 and vice versa. When the fixed space lanes are completely occupied by vehicles, part of the flexible space lanes 3 can be used to park the cars, as shown in FIG. 2. In the same way, some of the empty spaces between the elevators in the elevator lanes 2 can be used as fixed spaces for parking the vehicles.

The number of elevators 5 and flexible/fixed lanes and spaces is variable and is only dependent on the shape of the site and the available time for withdrawing and parking the vehicles.

Public access to the parking floors shown in FIG. 2 is prohibited and only car park maintenance staff are allowed to move about on these floors.

Each fixed parking space in each lane 4 is equipped with a mechanism to move the vehicle longitudinally in both directions, perpendicular to the length or is longitudinal axis of the lanes. These mechanisms can consist of fixed tables or platforms 6 with haulage facilities (not shown in particular) to move the vehicles.

The flexible spaces in lanes 3 are equipped with mechanisms to allow for the vehicle to be moved longitudinally and transversely, perpendicular and parallel to the lanes. These mechanisms can consist of tables or platforms 7 which can move in a lateral direction along automatic haulage facilities (not shown in particular) to move the vehicles perpendicular to the lanes.

The various automatic facilities can be electric, pneumatic or hydraulic.

The longitudinal movement of the cars on the tables or platforms of the fixed spaces in lane 4 can be carried out with the wheels of the vehicle in a locked position, with the car resting on top of a sliding rug on a pallet or with the car's wheels in motion, in which case it is necessary for the hand brake to be down and the car to be in neutral gear. In addition, a combination of these two systems can be used, i.e. the two wheels on one side in motion and the other two wheels supported on top of a sliding rug.

The tables of the flexible spaces in lane 3 rest on top of wheels, rugs, chains or rollers to enable lateral movement. This lateral movement can be caused by electric, pneumatic or hydraulic means and be either continuous or discontinuous.

The reception/delivery floor shown in FIG. 1 has direct access 8 from the public road. Within this floor there are pre-assigned fixed points 9 where the drivers leave their vehicles. At these points there are revolving tables or platforms 10 which have haulage facilities (not shown in particular) to move the vehicles longitudinally. The elevators 5 are also equipped with a table or platform of which the height may be varied, together with facilities to move the vehicles in a longitudinal direction.

In accordance with this embodiment, the vehicle can be parked by driving it through the access 8 to the reception floor, and placing it at one of the delivery points 9. The revolving table or platform 10 positions the vehicle 11 in such a way that it is in front of the elevator 5 the vehicle then being moved automatically into the elevator. The elevator takes the vehicle up to the required parking floor and it is then moved out of the elevator and to one of the flexible spaces in lane 3, along which it is moved laterally until is in front of one of the fixed spaces in a lane 4. It is then moved from the table or platform in lane 3 to the table or platform of the fixed space in lane 4, where it is parked.

To withdraw the vehicle, this process is carried out in reverse order, and an empty platform or table 7 from the adjacent lane 3 is positioned in front of the vehicle. The vehicle is then moved laterally along the lane until it is positioned in front of one of the elevators 5.

Both the vehicle delivery and withdrawal operations can be carried out automatically to put this process in motion, once the driver has left the vehicle at one of the fixed points 9 of the reception floor, he inserts a computer card bearing the details of the vehicle into a machine. In automatic fashion and without any action being necessary on the part of the driver, the vehicle is moved into the elevator and, by means of a corresponding computer process, is moved to a predetermined floor and fixed parking space.

In order to withdraw the vehicle, the driver uses the same card and the vehicle is returned to a set point mechanically, without any action being necessary to the part of the driver and with the engine turned off.

The car park can have one floor for both vehicle reception and delivery or one for reception and another for delivery.

As shown in FIG. 2, on each parking floor, within the flexible space lanes 3, there are empty spaces 12 which do not have moveable tables 7. These empty spaces are distributed in such a way than when the flexible tables 7 move horizontally, they can all reach at least one elevator 5.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. Multi-story car park, which includes at least one vehicle reception/delivery floor, with direct access from a public road, and at least one parking floor which is reached by at least one elevator from the reception/-delivery floor, the parking floors being divided into consecutive parallel lanes, all of which have a width approximately equal to the length of a vehicle to be parked in the car park and a length which is a multiple of the width of the vehicle, the lanes being sub-divided into elevator lanes having elevators, the elevators moving the vehicles vertically from and to the at least one reception/delivery floor; fixed space lanes for parking the vehicles, situated on either side of the elevator lanes; and flexible space lanes situated between the elevator lanes and the fixed space lanes, for moving the vehicles horizontally, perpendicular and parallel, to the elevator and fixed lanes; each fixed space defined along each fixed space lane having means for moving the vehicles longitudinally in both directions, perpendicular to the lane; at least some flexible spaces defined along each flexible space lane having means for longitudinal and transverse movement of the vehicles, perpendicular and parallel to the lane; at least one elevator defined in each said elevator lane having means for moving the vehicles through access doors, perpendicular to the elevator lane.

2. Car park as in claim 1, wherein the means for moving the vehicles from the fixed spaces consist of fixed tables or platforms, equipped with automatic haulage facilities to move the vehicles perpendicular to the lanes.

3. Car park as in claim 2, wherein along the entire length of the fixed space lanes there are fixed tables or platforms to receive the vehicles.

4. Car park as in claim 1, wherein the means for moving the vehicles in the flexible spaces, consist of tables or platforms which move laterally, parallel to the lanes, these tables having automatic haulage facilities to move the vehicles perpendicular to the lanes.

5. Car park as in claim 4, wherein there are empty spaces, without moving tables or platforms, in the flexible space lanes.

6. Car park as in claim 1, wherein the elevator lanes include fixed spaces located between the elevators, parallel to these elevators.

7. Car park as in claim 1, wherein the elevators have variable height tables or platforms, equipped with automatic haulage facilities to introduce and withdraw the vehicles, perpendicular to the lanes.

8. Car park as in claim 1, wherein the reception/-delivery floor(s) have platforms long enough to receive a vehicle, these revolving platforms being situated adjacent to the entrance/exit of the elevator and having automatic haulage facilities to move the vehicles longitudinally in both direction.

* * * * *